US005725196A

United States Patent [19]

Scheel

[11] Patent Number: 5,725,196

[45] Date of Patent: Mar. 10, 1998

[54] VARIABLE BOOK

[76] Inventor: Joachim Scheel, Am Bach 14, 27801 Doetlingen-Hockensberg, Germany

[21] Appl. No.: 518,497

[22] Filed: Aug. 23, 1995

[30] Foreign Application Priority Data

Aug. 26, 1994 [DE] Germany ..... 9413757 U

[51] Int. Cl.[6] ..... B42F 3/00; B42F 5/00

[52] U.S. Cl. ..... 281/21.1; 281/15.1; 281/38; 402/79

[58] Field of Search ..... 281/38, 15.1, 21.1, 281/22, 34–37, 42, 29; 402/79; 283/34–43, 63.1, 66.1; D19/26, 27, 32

[56] References Cited

U.S. PATENT DOCUMENTS

| | | | |
|---|---|---|---|
| D. 346,180 | 4/1994 | Sandoval | D19/27 |
| 1,719,412 | 7/1929 | Wigginton | 283/117 X |
| 2,330,457 | 9/1943 | Tremblett | 206/472 X |
| 3,972,632 | 8/1976 | Carter | 281/38 X |
| 4,019,823 | 4/1977 | Kleinert et al. | 281/29 X |
| 4,620,725 | 11/1986 | Maehashi | 281/31 X |

FOREIGN PATENT DOCUMENTS

| | | | |
|---|---|---|---|
| 725357 | 5/1932 | France | 281/34 |
| 453988 | 12/1927 | Germany | 281/36 |
| 578839 | 6/1933 | Germany | 281/34 |
| 602252 | 9/1934 | Germany | 402/79 |
| 624506 | 1/1936 | Germany | 281/34 |
| 658828 | 12/1986 | Switzerland | 281/34 |

*Primary Examiner*—Frances Han
*Attorney, Agent, or Firm*—Wood, Herron & Evans, L.L.P.

[57] ABSTRACT

A book having concertina folded sheets which are detachably connected to one another. The opposed edges of the sheets are connected by removable fasteners or an adhesive permitting the adjacent sheets to be readily separated.

16 Claims, 1 Drawing Sheet

VARIABLE BOOK

DESCRIPTION

The present invention relates to a book, the information range of which can be adapted to individual requirements by adding, removing or exchanging sheets.

In museums or places of interest to tourists, books or strips of photographs relating to this museum, the locality, a castle or a landscape are nowadays always offered for sale. Such books enjoy great popularity, although by necessity they have to represent a compromise between the interests of different purchasers. For not every purchaser has the same level of interest in all aspects of the place or museum visited, but normally has particular special interests. It is often not simple to find a book which takes a special interest into consideration, with the result that the purchaser is forced to procure a general book with all kinds of information padding which he then has to supplement by his own notes or photos, which have to be kept in a blank album, for example. Not every purchaser is equally in the position to produce such an album, moreover such a blank album can only in a few cases be expanded by intermediate pages at a later date.

A known form of a book which can be adapted with respect to its information content to individual interests is a ring binder. In a ring binder the individual sheets are retained by claws, which together are attached with an opening and closing mechanism on the book spine. By opening the claws sheets can be inserted into the book, removed from the book or exchanged. In this case the external dimensions of the book are determined in advance by the binding with the book covers, the book spine and the mechanism with the claws. These dimensions are completely independent of how many sheets there are in the book. Moreover the filing of chests with different aspect ratios can only be unsatisfactory.

An alteration in the information content of a buck of the known type often results in an unsatisfactory result on account of the properties described: because of the essentially fixed aspect ratio of its shoots illustrations often only fill just a part of the format.

Furthermore a book which, despite its large external dimensions, only contains a few pages, gives a poor impression, while the choice of a thin book from the very beginning greatly restricts the number of sheets which can be inserted.

For the reasons mentioned a variable book of the known type is not possible for representative purposes and is not particularly attractive for the purchaser.

The object of the invention is therefore to create a book which can be varied with respect to its information content, which at least largely avoids the disadvantages of the above-mentioned prior art and offers further possibilities of individual design.

This object is achieved in accordance with the present invention in that the individual sheets of a book are concertina-folded and are detachably connected to one another successively. In this case one sheet can include several pages of the concertina fold.

The advantages of such a book lie in the fact that the detachable connection between the individual sheets enables the insertion, removal or exchange of a number of sheets, that because of the concertina folding for example illustrations with any aspect ratio can be printed to fill the page and that moreover such a book is never thicker or thinner than its actual content dictates.

For such a book preprinted sheets on individual themes can be offered for sale, which can De assembled and if necessary combined with blank sheets. A travel album may be compiled, for example, of blank sheets provided with the purchaser's photos and preprinted sheets on the history or special nature of this landscape to correspond to the purchaser's own particular interests. Instead of blank sheets, partially printed sheets can also be offered for sale, which for example contain, apart from the preprinted text, empty spaces for photos to be taken by the purchaser himself. In precisely the same manner it is possible to compile a book completely or preprinted sheets. In this case it should be borne in mind that the extent and size of the text or pictures can vary greatly, so that a variety formats for the supplementary sheets is desirable. Likewise the sequence of sheets in the book and also the overall extent of this book can be determined by the purchaser himself.

Further advantages are produced if the individual sheets are prepared at one edge at least for detachable connection with on adjacent sheet, so that the insertion, removal or exchange of sheets for the purchaser of a book or a number of supplementary sheets is associated with minimal expenditure.

The detachable connection can be produced by mechanical connecting elements such as, for example, press fasteners or a detachable glued joint. Moreover the connection means can be chosen for example in the form of a detachable adhesive strip, so that it produces the connection by bridging the separating region between two sheets. With such a connection two adjacent sheets would not overlap.

The realisation of the connection of two sheets becomes particularly simple if the edge regions of two connected sheets overlap. A folding line next to the overlapping zone in one of the adjacent sheets facilitates the concertina folding operation.

A plurality of possible overlapping arrangements is produced from the preferred provision of the edge region of a sheet with one or more tab-shaped projections.

Preferred connecting means are a detachable glued joint or press fasteners. Advantageous designs of a sheet for the use of the respective connecting means emerge from the corresponding sub-claims.

The drawings show a book in accordance with the invention as a whole and several possible embodiments of the connection between two sheets. In detail:

Figure 1:
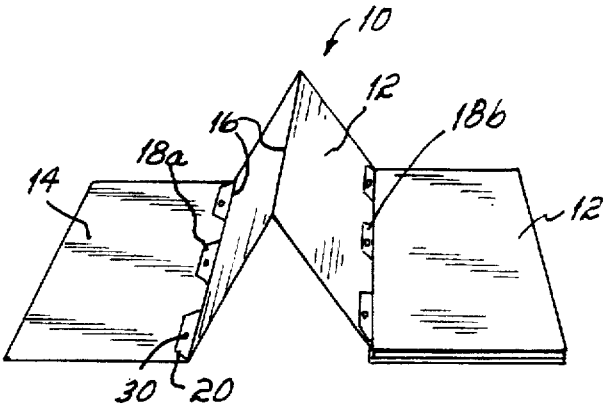
FIG. 1 is a perspective overall view of a book according to the invention.

From FIG. 1 it can be seen how a book 10 is composed individual sheets 12: by connecting the individual sheets 12 a sequence of sheets is produced, which by the concertina folding produces the pages of the book 10. In this case each sheet 12 normally has two adjacent sheets, i.e. the preceding sheet and the following sheet in the sequence. Only its first and last sheets have just one adjacent sheet as a cover sheet 14. In order to predetermine the fold for sheets 12. As one sheet 12 may also form several pages of the book 10, it may also be equipped with several folding lines 16. In the embodiment represented an edge region 18*a* of each sheet has tab-like projections 20 close to a folding line 16, while the opposite edge region 18*b* of the same sheet is designed in one piece and without a folding line.

The edge regions 18*a*, 18*b* of the adjacent sheets 12 overlap and are provided with holes 22. The holes 22 serve to receive press fasteners 30 and are disposed so that the holes 22 of one sheet 12 are precisely covered with those of the adjacent sheer when the sheets 12 are aligned with respect to one another in the desired manner. The precise centring of tie holes 22 lying one over the other occurs by a press fastener 30, so that the tedious alignment of the sheets 12 with respect to one another which would otherwise be necessary is not required.

Figure 2:
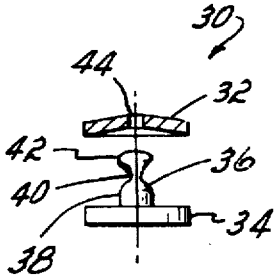
FIG. 2 is a side view of a press fastener, partially in section.

As shown in FIG. 2, a preferred embodiment of the press fastener 30 is designed in two parts. This press fastener has a conical separate flange 32 and a flange 34 which is connected to a shaft 36. The shaft 36 is shaped so that at its end region 38 closer to the flange 34 it has a diameter corresponding to the diameter of the holes 22. This part of the shaft serves to centre the holes 22. In the direction of its free end the shaft firstly has a constriction 40 and finally a thickened end region 42 having a diameter which is larger than in the region of the constriction, but not larger than in the flange-side end region 38. The separate flange 32 is provided with a central opening 44 to receive the shaft 36. The diameter of the opening 44 is smaller then the thickened end region 42 of the shaft 36. If the shaft 36 of the press fastener 30 is passed through the holes 22 of two overlapping edge regions of adjacent sheets of the book, the thickened end region 42 of the shaft 36 protrudes out of the holes 22 lying over one another, so that the separate flange 32 with its opening 44 can be placed on the shaft 36. By exerting slight pressure the conical flange 32 becomes flatter and locks with its opening 44 in the constriction 40 of the shaft 36. After releasing the pressure, the flange 32 tries, on account of its elasticity, to reassume its original conical shape. In so doing the shaft 36 is elastically stretched, so that the two flanges 32, 34 of the press fastener 30 are braced against one another and the sheets 12 are jammed therebetween so that they are frictionally connected to one another. The press fastener 30 is preferably made of an elastic material such as nylon, for example.

Figure 3:
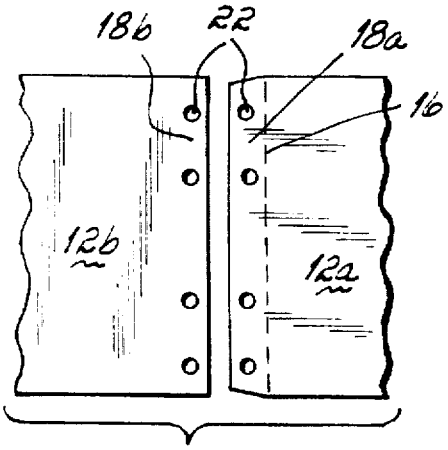
FIG. 3 is a top view of two sheet edges with a single-part tab

The invention contains many suggestions for the shaping of the edge regions 18 of adjacent sheets. As shown in FIG. 3 the edge regions 18*a* and 18*b* of the adjacent sheets 12*a*, 12*b* are designed in one piece. Edge region 18*b* only has holes 22, while in the case of edge region 18*a* a folding line 16 is additionally provided. The holes 22 are positioned as explained in the description relating to FIG. 1.

Figure 4:
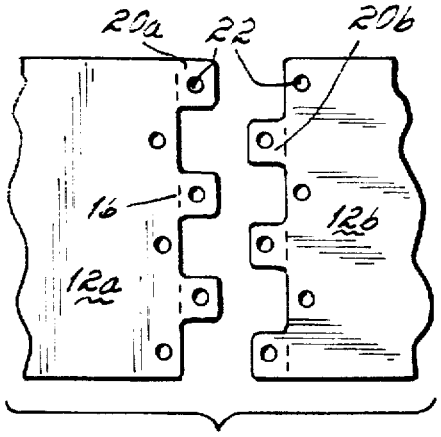
FIG. 4 is a top view of two sheet edges with multi-part tabs.

An example of how the edge regions 28 of adjacent sheets 12 can be designed in several parts is given in FIG. 4. By the multi-part design of the edge regions 18 they have tab-like projections 20*a*, 20*b*. As depicted, the holes 22 are disposed alternately staggered in the tab-like projections 20*a*, 20*b* and between them further into the sheet. Here too the holes are congruent in pairs when the sheets 12*a*, 12*b* are mutually aligned and the edge regions 18 overlap. Folding line 16 in the vicinity of the sheet-side end of the projections 20 are situated on the tab-like projections 20.

The overlapping shapes of the edges regions 18 of adjacent sheets 12 are just as numerous as the shapes of these edge regions 18.

Figure 5:
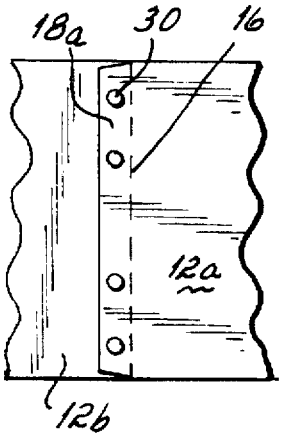
FIG. 5 is a top view of connection between two sheets which overlaps on one side.

The simplest form is overlapping on one side, as represented in FIG. 5. With this form of overlapping the edge regions 18 of two adjacent sheets lie over one another so that the edge region 18*a* of the one sheet 12*a* lies completely on the one side of the sequence of there two sheets, while the edge region 18*b* of the second sheet 12*b* lies completely on the other side of the sequence. The edge regions 18 of the sheets 12 may be designed in one part, as represented in FIG. 3.

Figure 6:
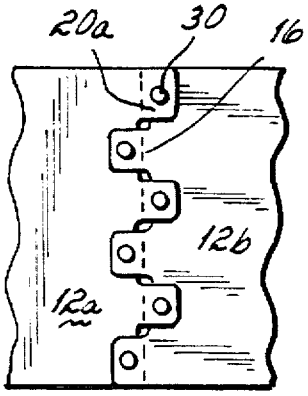
FIG. 6 is a top view of an interlocking connection between two sheets.

In the case of the interlocking overlapping shown in FIG. 6, the edge regions 18 of two adjacent sheets 12*a*, 12*b* comprise tab-like projections 20*a*, 20*b*, as shown in FIG. 4, the shape of which permits the tab-like projections 20*a* of the one sheet 12*a* to engage in the recesses between the tab-like projections 20*b* of the other sheet 12*b*. When the two sheets 12 are connected to one another so that their edge regions 18 overlap, all tab-like projections 20 of both sheets 12 lie on one side of the sequence.

Figure 7:
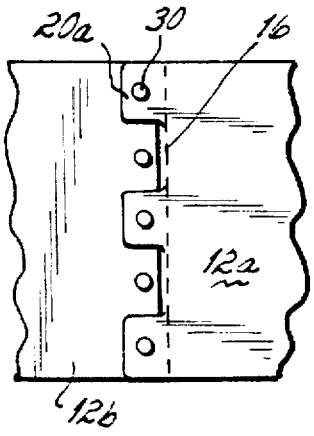
FIG. 7 is a top view of a connection between two sheets which overlaps on alternate sides.

When the edge region 18*a* of a sheet 12*a* is designed in several parts—the edge region 18*b* of the second sheet 12*b* can be left in one piece—it is also possible to produce the connection between two sheets 12*a*, 12*b* so that the tab-like projections 24*a* of the one sheet 12*a* lie alternately firstly on the one side, secondly on the other side of the sheet 12*b*, as shown in FIG. 7.

In the normal case with all sheets 12 except for the cover sheets 14 two opposite edge regions 18 of each sheet 12 are prepared for the production of the connection. Nevertheless it is of course also possible to prepare further edge regions 18 of a sheet 12 so that sheets 12 may also be attached there. It is important that the connection between the sheets 12 is detachable.

Two sheets 12 may also be connected by a detachable glued joint instead of by means of press fasteners. In this case the preparation of the sheets consists in coating the adhesion face on one of the two sheets with adhesive or with a double-sided adhesive tape. On the other sheet the adhesion face is then prepared by waxing, for example, so that the adhesive adheres less well there. Here the bond is chosen so that the glued joint can be separated again without damaging the sheets.

I claim:

1. A book which can be varied with respect to a range of information comprising concertina-folded sheets detachably connected to one another with one sheet being folded to comprise at least two sheets of the book, wherein the concertina-folded sheets comprise:

first sheet and last sheets, each sheet having one edge detachably connected with an edge of an adjacent sheet; and other sheets between the first and last sheet having first and opposite edges, each of the other sheets having a first edge detachably connected to an opposite edge of a first adjacent sheet and each of the other sheets having an opposite edge detachably connected with a first edge of a second adjacent sheet.

2. A book according to claim 1 wherein the edges of two connected sheets overlap and a folding line is provided adjacent to one of the edges.

3. A book according to claim 1 wherein each of the first and the opposite edges includes at least one tab-like projection.

4. A book according to claim 1 wherein the edges of the sheets overlap, and the sheets are detachably connected to one another by press fasteners in a region of the overlap.

5. A book according to claim 4, wherein the region of the overlap includes holes to receive the press fasteners, which are then congruent in pairs when the sheets are aligned with respect to one another in their specified position.

6. A book according to claim 5 wherein the press fastener includes a first flange located on one side of the sheets to be connected and a second flange on an opposite side of the sheets to be connected after closing the press fastener by clamping the first and second flanges against the sheets.

7. A book comprising:

first and last pages, each of the first and last pages having one edge detachably connected to an edge of an adjacent page;

a plurality of other pages disposed between the first and last pages, each of the other pages having opposite edges detachably connected to edges of two different adjacent pages, the first, the other and the last pages being detachably connected in succession and each of the pages being folded in alternate directions to provide a concertina-folding of the pages to form the book which by detaching selected pages, selectively adding and removing pages and detachably connecting the pages may be varied in information content.

8. The book of claim 7 wherein one of the other pages having at least one fold located between and parallel to the edges, thereby forming two pages.

9. The book of claim 8 wherein the overlap portion comprises a first tab along the edge of each of the other pages for receiving an edge region of an adjacent page.

10. The book of claim 9 wherein the edge region further comprises a second tab located in a nonoverlapping relationship with the first tab.

11. The book of claim 7 comprising an overlap portion along one edge of each of the other pages and an edge region of an adjacent page.

12. The book of claim 11 wherein the overlap portion of the edge of each of the other pages is folded with respect to a respective other page and the edge portion of the adjacent page is disposed between the folded edge portion and the respective other page.

13. The book of claim 12 comprising at least one hole in the overlap portion of the one edge of each of the other pages.

14. The book of claim 13 comprising at least one hole in the edge region of each adjacent page aligned with the hole in the overlap portion of the edge of each of the other pages.

15. The book of claim 14 comprising a plurality of detachable fasteners, each fastener extending through the hole in the overlap portion of the edge of one of the other pages and the hole in the edge region of an adjacent page to join the one of the other pages with the adjacent page.

16. The book of claim 15 wherein each of the fasteners comprises:

a shaft extending through the holes;

a first flange attached to one end of the shaft and located on an outerside of the overlap portion; and a second flange attached to an opposite end of the shaft and located on an outerside of the adjacent sheet.

* * * * *